US005215364A

United States Patent [19]

Moore

[11] Patent Number: 5,215,364

[45] Date of Patent: Jun. 1, 1993

[54] RECIPE FILE

[76] Inventor: Harold G. Moore, Rte. 5, Box 158 J, Staunton, Va. 24401

[21] Appl. No.: 802,034

[22] Filed: Dec. 3, 1991

[51] Int. Cl.[5] ..... A47B 88/06

[52] U.S. Cl. ..... 312/323; 40/159; 40/394

[58] Field of Search ..... 40/391, 394, 537, 159; 312/183, 323, 245

[56] References Cited

U.S. PATENT DOCUMENTS 1,710,796 4/1929 Garrow ..... 40/394
1,956,392 4/1934 Leth ..... 40/159
2,178,638 11/1939 Link ..... 40/394 X

*Primary Examiner*—Peter R. Brown
*Attorney, Agent, or Firm*—Richard C. Litman

[57] ABSTRACT

A recipe file which mounts on the undersurface of an overhead wall mount kitchen cabinet. The recipe file includes a housing frame which can being used singly or may be adapted to accommodate a plurality of pivotally mounted file drawers. Each file drawer contains a plurality of pivotally attached cascading transparent jackets, each having an opening whereby a recipe card may be slidably inserted. The recipe card is imprinted with indicia detailing the recipe. The face of the file drawer is configured to accept a display plate imprinted with indicia describing the content of the file drawer. The file drawers each have an angular bend along the horizontal axis located near the rear of the file drawer together with pivots slidable in tracks to permit the file drawer to assume an inclined position when the drawer is pulled out of the housing frame to provide a cantilever formation. This cantilever formation functions to extend the file drawer a distance from the kitchen cabinet sufficient to grant optimum management and visibility of the recipe cards.

16 Claims, 3 Drawing Sheets

FIG. 1
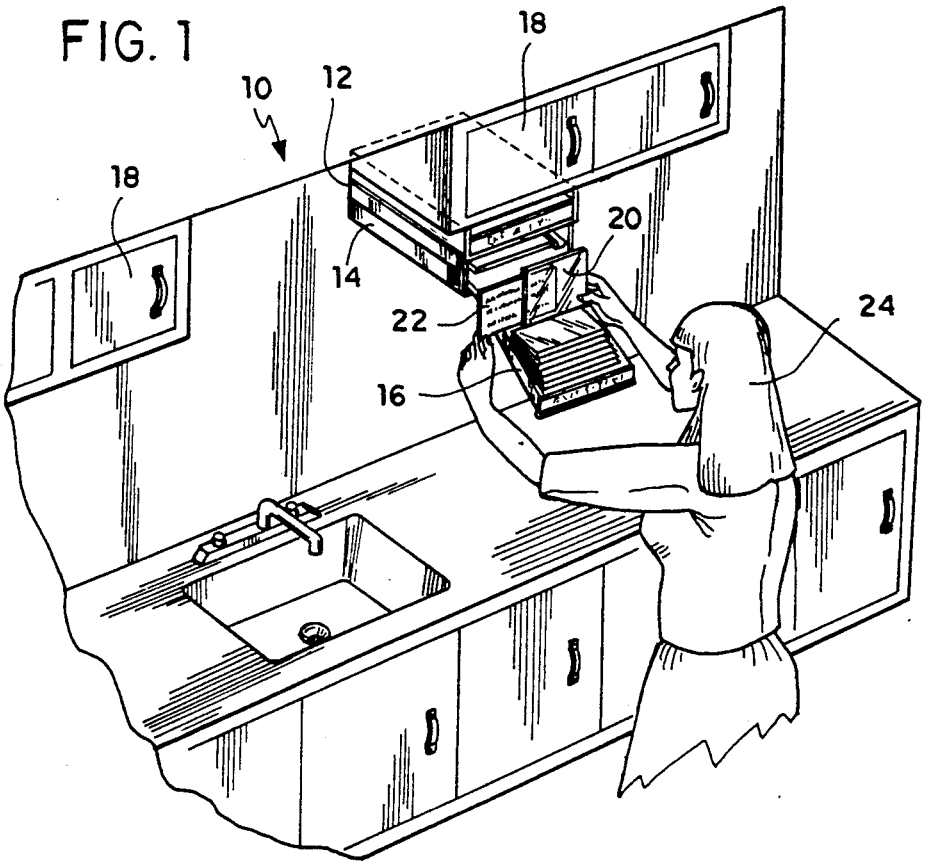
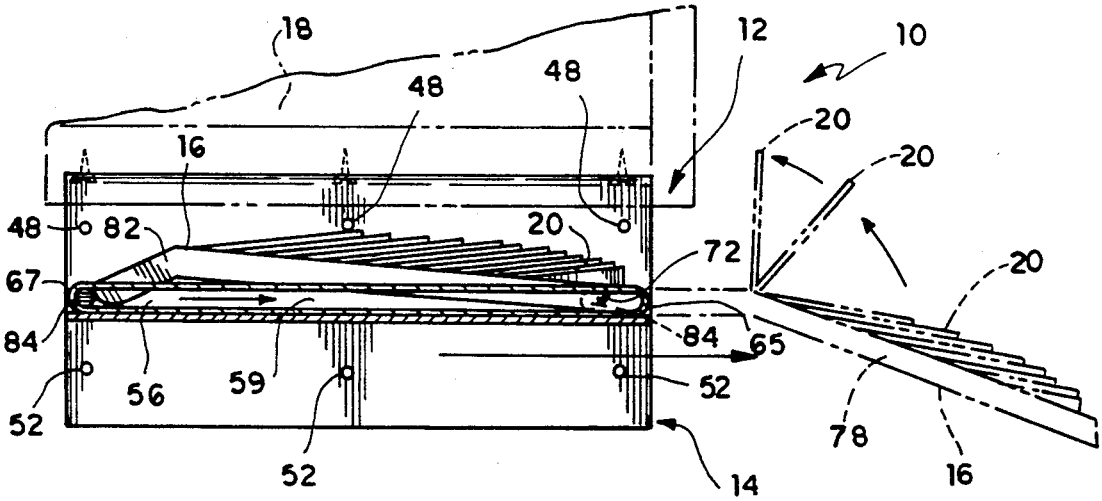
FIG. 3

DESSERT
APPLE PIE

RECIPE FILE

BACKGROUND OF THE INVENTION

1. Field of the Invention

The present invention relates to a recipe file and more particularly, a recipe file which mounts under an overhead kitchen cabinet.

2. Description of Prior Art

There is an ongoing trend to preserve kitchen counter top space. This trend was initiated originally by a reduction in the size of homes paralleled by smaller kitchens. This desire to preserve kitchen counter space, however, has now become widespread in larger, more spacious home where a premium on counter space does not exist. This is evident by the abundance of available toasters, coffee makers, and can openers, just to name a few, which are designed to be mounted in a suspended fashion under wall mount overhead kitchen cabinets.

U.S. Pat. No. 2,706,141 issued Apr. 12, 1955 to Ellsworth G. Layer shows a cabinet which includes a plurality of drawers which contain index cards.

U.S. Pat. No. 4,105,270 issued Aug. 8, 1978 to Helen G. Bergkamp et. al. discloses a recipe card storage device which is mounted on a kitchen cabinet or table.

U.S. Pat. No. 4,184,725 issued Jan. 22, 1980 to James L. Spangler shows a book-holding apparatus mounted on the underside of a kitchen cabinet.

U.S. Pat. No. 4,657,193 issued Apr. 14, 1987 to Stephen L. Whittenburg et. al. discloses a food processor for installation on the underside of the kitchen cabinet.

U.S. Pat. No. 4,663,849 issued May 12, 1987 to Robert W. Nickelson shows a combination can opener and knife sharpener which mounts on the underside of a kitchen cabinet.

None of the above inventions and patents, taken either singly or in combination, is seen to describe the instant invention as claimed.

SUMMARY OF THE INVENTION

The present invention relates to a recipe file which mounts on the undersurface of an overhead kitchen cabinet. The recipe file includes a file drawer slidably attached to a first frame assembly. The file drawer retains a series of transparent jackets which facilitate the insertion of recipe cards. The transparent jackets protect the recipe cards while being handled and are removable to enable the user to carry the recipe cards to a particular work surface. The front of the drawer includes an upper channel and a lower channel which, in combination, retain a slidably engagable plate which provides a display of the general contents of the drawer. The first frame mounts on the under surface of an overhead wall mount kitchen cabinet. A file drawer is slidably disposed in one or more tracks. The file drawer is pivotally engaged with the tracks to permit the file drawer, when in the opened position, to pivot into an inclined position. This offers optimum management and visibility of the recipe cards. A plurality of subsequent frame sections enable the user to successively suspend one subsequent frame section from a previous frame section providing a series of file drawers beneath the cabinet. The first frame and subsequent frame sections are easy to install. Installation can be accomplished with the use of self-tapping screws. No drilling is required.

Accordingly, one object of the present invention is to provide a recipe file which mounts on the bottom surface of a wall mount kitchen cabinet, thus preserving counter top space.

Another object of the present invention is to provide a recipe file having a drawer assuming a reclined position offering optimum management and visibility of the recipe cards.

Another object of the present invention is to provide a removably attached transparent jacket to accommodate the insertion of a recipe card.

A further object of the present invention is to provide a recipe file having a drawer which maintains recipe cards in a staggered arrangement.

Yet another object of the present invention is to provide a succession of file drawers in suspension under a wall mount cabinet.

These and other objects of the present invention will become readily apparent upon further review of the following specification and drawings.

BRIEF DESCRIPTION OF THE DRAWINGS

FIG. 1 is an environmental view of the recipe file according to the present invention.

FIG. 3 is a side elevation of the recipe file according to the present invention showing the cards maintained in a staggered arrangement.

Similar reference characters denote corresponding features consistently throughout the attached drawings.

DETAILED DESCRIPTION OF THE PREFERRED EMBODIMENT(s)

Figure 2:
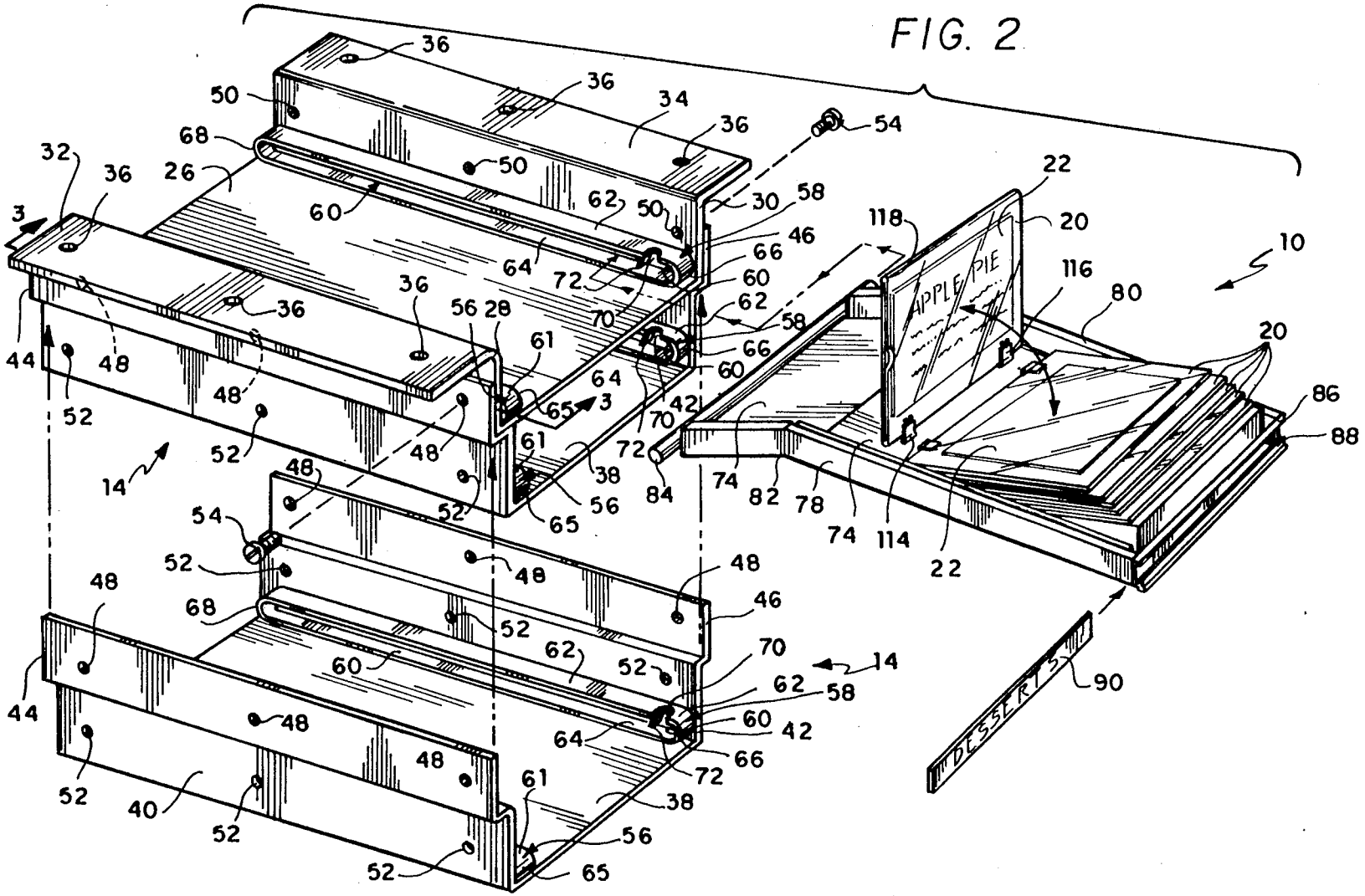
FIG. 2 is a partially exploded view of the recipe file according to the present invention.

Now referring to the drawings, FIG. 1 illustrates the recipe file 10 according to the present invention. The recipe file 10 includes a first frame 12 and a subsequent frame 14, each containing a slidably engagable file drawer 16. The first frame 12 is secured to the bottom surface of an overhead wall mount kitchen cabinet 18. The file drawers 16 maintain a series of transparent jackets 20 permitting the insertion of a recipe card 22 by the user 24.

FIG. 2 shows the first frame 12 having a substantially U-shaped formation comprising a substantially horizontal rectangular base plate 26 integrally joined along the left and right edges to a substantially vertical left and right plate 28,30 which are further perpendicularly affixed to a left and right flange 32,34 extending to the left and right of the first frame 12, respectively. The left and right flanges 32,34 each include apertures 36 for the passage of the hardware used to install the first frame 12 on the under surface of the kitchen cabinet 18. Subsequent frames 14 can be sequentially suspended below the first frame 12. The subsequent frames 14 are comprised of a substantially U-shaped section including a substantially horizontal rectangular base plate 38 having left and right edges and left and right plates 40,42 attached perpendicularly thereon. Left and right L-shaped flanges 44,46 are perpendicularly attached to the upper edge of the left and right plates 40,42 extending to the left and the right of the subsequent frame 14, respectively. The inside surface of the left and right L-shaped flanges 44,46 are each configured to conformed to the outside surface of a first frame 12 or a subsequent frame 14. Holes 48 are provided in the left and right L-shaped flanges 44,46 which align with threaded bores 50 in left and right vertical plates 28,30 of the first frame 12 or with threaded bores 52 in the left and right plates 40,42 of the subsequent frame 14. With the holes 48 and the threaded bores 50 or 52 properly aligned, screws 54 may be inserted in the holes 48 and tightened into the threaded bores 50 or 52 to secure the first frame 12 and the subsequent frames 14.

The first frame 12 and the subsequent frames 14 include a left and right elongated track 56,58 affixed to the base plate 26,38 adjacent the left and right vertical plates 28,30 or the left and right plates 40,42. The left and right tracks 56,58 are provided with elongated openings 59,60, one opening 59 facing the other opening 60. The openings 59,60 are each defined by left and right upper horizontal members 61,62 and left and right lower horizontal members 63,64 integrally joined by left and right front semi-circular ends 65,66 and left and right rear semi-circular ends 67,68. A forward upper portion of at least one track 56,58 comprises a cutout 70 and a tongue 72.

The file drawer 16 has a front base section 74 and a rear base section 76 with a left and right edge joined to a left and right side 78,80. The left and right sides 78,80 are substantially vertical sections and each include an angular bend 82 in the rear portion introducing an angular bend between the front and rear base sections 74,76. The transparent jackets 20 and the recipe cards 22 are pivotally attached to the front base section 74 of file drawer 16 cascading in a direction from the rear to the front. A shaft 84 is located adjacent the rear of the rear base section 76. The shaft 84 is engaged in the cutout 70 and is slid to the rear under the tongue 72. The vertical distance provided between the tongue 72 and the inside surface of the lower horizontal member 64 is within a close tolerance to the diameter of the shaft 84 to offer a captive opening for the shaft 84 to pass through. This tongue 72 reduces the risk of the file drawer 16 inadvertently pulling out of the first or subsequent frame 12,14. The front most portion of the file drawer 16 has a substantially horizontal upper gutter 86 facing and parallel with a lower gutter 88 extending from the left extreme to the right extreme of the file drawer 16. A display plate 90 is slidably engagable between the upper and lower gutter 86,88. The display plate 90 allows the user 24 to display and identify the general content within the file drawer 16.

As shown in FIG. 3, the first frame 12 is mounted on the underside of a overhead wall mount kitchen cabinet 18. The file drawer 16 is pulled out of the first frame 12 and the forward motion of the file drawer 16 is restricted by the tongue 72 and is permitted to rest in a reclined position extended beyond the front surface of the overhead kitchen cabinet 18 providing a clearance between the recipes cards 16 and the overhead kitchen cabinet 18. The recipe cards 16 are pivotally attached and cascade from the rear portion to the front portion of the front base section 74 of the file drawer 16.

Figure 4:
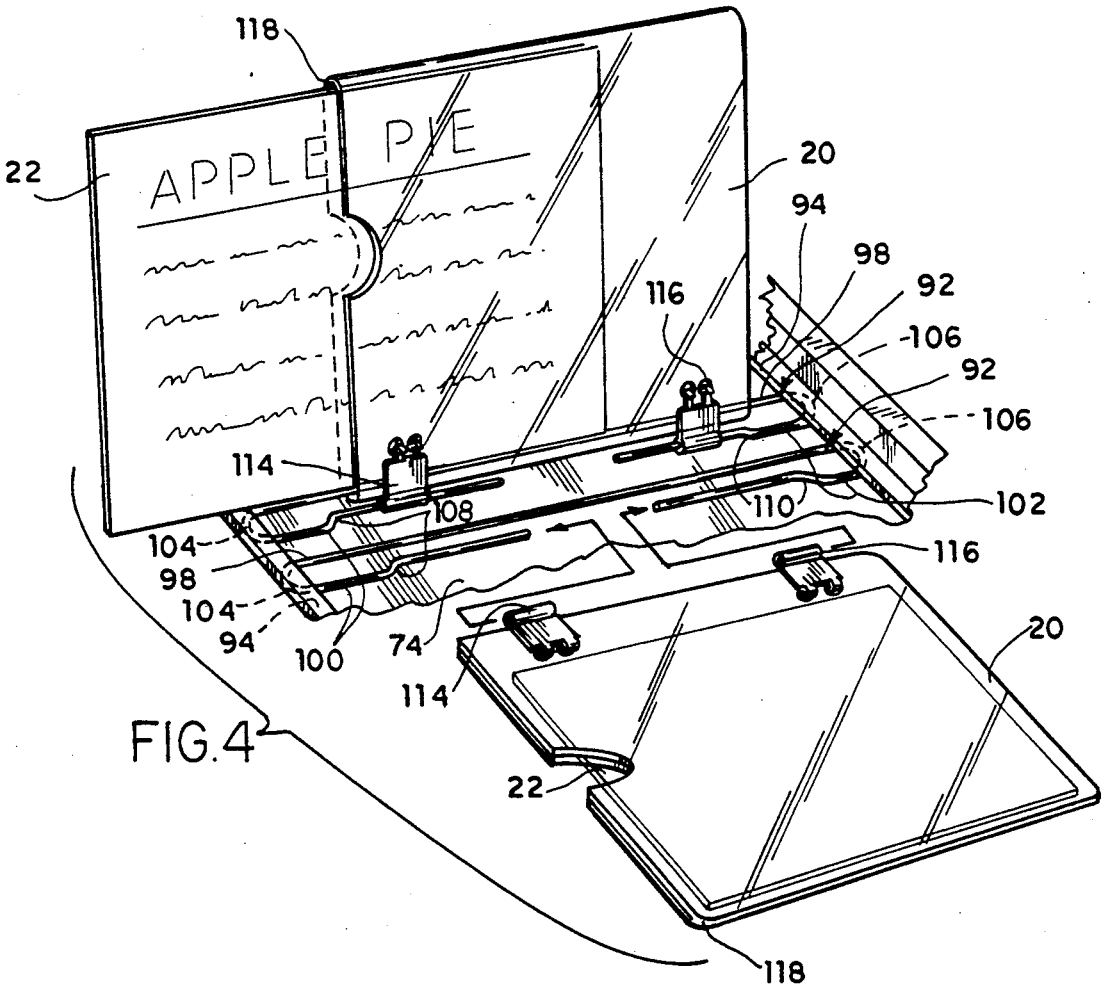
FIG. 4 is a perspective view of the recipe file according to the present invention showing the removable attachment of the recipe cards.

Referring to FIG. 4, the transparent jackets 20 are retained by a retainer clip 92 which extends from the inside surface of the left side 78 of the file drawer 16 of the inside surface of the right side 80 of the drawer 16. A slot 94 is defined between the top surface of the front base section 74 and the rear base section 76 and an elongated member 96 horizontally extending from the front to the rear of the file drawer 16. The slot 94 provides a snug fit configuration whereby the left and right ends of the retainer clip 92 are inserted. The retainer clip 92 includes a substantially straight longitudinal cylindrical element 98 substantially parallel to a left and right cylindrical element 100,102 separated at the center and connected to the longitudinal cylindrical element 98 by a left and right semi-circular end 104,106 adjacent each of the right and left sides of the file drawer 16, respectively. The left and right cylindrical members 100,102 each, respectively, have an offset portion 108,110 adjacent the left and right sides 78,80 of the file drawer 16. The offsets 108,110 keep the recipe cards 16 evenly spaced apart when one retainer clip 92 juxtaposed to another retainer clip 92.

The transparent jackets 20 have a left and right sleeve 114,116 clamped onto the bottom edge of the transparent jacket and equally spaced from the center of the transparent jacket 20. These sleeves 114,116 enable the user 24 to remove and replace the transparent jackets 20 along with the respective recipe cards 16. The transparent jackets 20 include a slit 118 long the entire length of one edge to permit the insertion of the recipe cards 16.

It is to be understood that the present invention is not limited to the sole embodiment described above, but encompasses any and all embodiments within the scope of the following claims.

I claim:

1. A recipe card storage device for storing and displaying recipe cards therein, the device comprising:

a plurality of recipe cards, each having indicia pertaining to a recipe imprinted thereon;

a slidable drawer for storing and displaying said plurality of recipe cards therein;

means for releasably fastening said recipe cards to said slidable drawer;

a housing frame for slidable engagement and disengagement of the slidable drawer therein; and means to secure said housing frame to a bottom of a wall mounted cabinet;

said slidable drawer including a front base section, which includes said means for releasably fastening said recipe cards to said slidable drawer, and a rear base section, there further being a lateral bend defined between said front base and rear base sections, such that said front base and rear base sections are angularly related to one another, said rear base section including laterally extended shaft means affixed to an end of said base section remote from said front base section;

said housing frame being substantially U-shaped;

said housing frame including guide means for receiving said shaft means in sliding engagement therewith, said guide means being located within the lower portion of said housing frame and being generally coextensive therewith, from the front to the back of said housing frame, said guide means including cutout means at a forward end of said guide means, for facilitating insertion of said shaft means into said guide means, and tongue means adjacent said cutout means, for forming an abutment to limit the forward travel of said shaft means and thus said slidable drawer as it is pulled from said housing frame, said tongue means further functioning to prevent said slidable drawer from being accidently disengaged from said housing frame.

2. The device according to claim 1 wherein said means for releasably fastening said recipe cards to said slidable drawer includes a transparent jacket having an opening to enable the insertion of said recipe card and which is pivotally fixed to said slidable drawer.

3. The device according to claim 1, wherein said device includes at least a second frame attached to said housing frame to provide a least a second slidable drawer for storing and displaying at least a second plurality of recipe cards.

4. The device according to claim 1, wherein said plurality of recipe cards are fastened in a cascading arrangement.

5. The device according to claim 1, wherein said slidable drawer includes a display plate identifying the contents contained in said slidable drawer.

6. A recipe card storage device for storing and displaying recipe cards therein, the device comprising:

a plurality of recipe cards, each having indicia pertaining to a recipe imprinted thereon;

a slidable drawer for storing and displaying said plurality of recipe cards therein;

means for fastening said recipe cards to said slidable drawer essentially in a cascading arrangement;

a housing frame for slidable engagement and disengagement of said slidable drawer therein; and means to secure said housing frame to a bottom of a wall mounted cabinet;

said slidable drawer including a front base section, which includes said means for releasably fastening said recipe cards to said slidable drawer, and a rear base section, there further being a lateral bend defined between said front base and rear base sections, such that said front base and rear base sections are angularly related to one another, said rear base section including laterally extended shaft means affixed to an end of said base section remote from said front base section;

said housing frame being substantially U-shaped;

said housing frame including guide means for receiving said shaft means in sliding engagement therewith, said guide means being located within the lower portion of said housing frame and being generally coextensive therewith, from the front to the back of said housing frame, said guide means including cutout means at a forward end of said guide means, for facilitating insertion of said shaft means into said guide means, and tongue means adjacent said cutout means, for forming an abutment to limit the forward travel of said shaft means and thus said slidable drawer as it is pulled from said housing frame, said tongue means further functioning to prevent said slidable drawer from being accidently disengaged from said housing frame.

7. The device according to claim 6, wherein said means for fastening said recipe cards to said slidable drawer includes a transparent jacket having an opening to enable the insertion of said recipe card and which is pivotally fixed to said slidable drawer.

8. The device according to claim 6, wherein said means for fastening said recipe cards to said slidable drawer includes a releasable means for fastening said recipe cards to said slidable drawer.

9. The device according to claim 6, wherein said device includes at least a second frame attached to said housing frame to provide a least a second slidable drawer for storing and displaying at least a second plurality of recipe cards.

10. The device according to claim 6, wherein said slidable drawer includes a display plate identifying the contents contained in said slidable drawer.

11. A recipe card storage device for storing and displaying recipe cards therein, the device comprising:

a plurality of recipe cards, each having indicia pertaining to a recipe imprinted thereon;

a slidable drawer for storing and displaying said plurality of recipe cards therein;

means for fastening said recipe cards to said slidable drawer;

a housing frame for slidable engagement and disengagement of the slidable drawer therein providing a pivot for said slidable drawer, whereby said slidable drawer assumes an inclined position when pulled out therefrom; and means to secure said housing frame to a bottom of a wall mounted cabinet;

said slidable drawer including a front base section, which includes said means for releasably fastening said recipe cards to said slidable drawer, and a rear base section, there further being a lateral bend defined between said front base and rear base sections, such that said front base and rear base sections are angularly related to one another, said rear base section including laterally extended shaft means affixed to an end of said base section remote from said front base section;

said housing frame being substantially U-shaped;

said housing frame including guide means for receiving said shaft means in sliding engagement therewith, said guide means being located within the lower portion of said housing frame and being generally coextensive therewith, from the front to the back of said housing frame, said guide means including cutout means at a forward end of said guide means, for facilitating insertion of said shaft means into said guide means, said shaft means cooperating with said guide means to provide said pivot for said slidable drawer, and tongue means adjacent said cutout means, for forming an abutment to limit the forward travel of said shaft means and thus said slidable drawer as it is pulled from said housing frame, said tongue means further functioning to prevent said slidable drawer from being accidently disengaged from said housing frame.

12. The device according to claim 11, wherein said means for fastening said recipe cards to said slidable drawer includes a transparent jacket having an opening to enable the insertion of said recipe card and is pivotally fixed to said slidable drawer.

13. The device according to claim 11, wherein said means for fastening said recipe cards to said slidable drawer includes a releasable means for fastening said recipe cards to said slidable drawer.

14. The device according to claim 11, wherein said device includes at least a second frame attached to said housing frame to provide a least a second slidable drawer for storing and displaying at least a second plurality of recipe cards.

15. The device according to claim 11, wherein said plurality of recipe cards are fastened in a cascading arrangement.

16. The device according to claim 11, wherein said slidable drawer includes a display plate identifying the contents contained in said slidable drawer.

* * * * *